United States Patent [19]

Golden

[11] 4,014,416

[45] Mar. 29, 1977

[54] ATTACHE CASES

[76] Inventor: Harold Golden, 107 3616 Barham Blvd., Los Angeles, Calif. 90068

[22] Filed: Jan. 20, 1976

[21] Appl. No.: 650,625

[52] U.S. Cl. ..... 190/42; 150/52 G

[51] Int. Cl.[2] ..... A45C 3/00

[58] Field of Search ..... 206/315; 150/52 G, 1.6, 150/34; 190/52, 51, 42, 60, 41 R; 273/74; 220/345, 346

[56] References Cited

UNITED STATES PATENTS

| | | | |
|---|---|---|---|
| 1,167,768 | 1/1916 | Lochner | 220/345 X |
| 1,511,613 | 10/1924 | Joern | 220/345 X |
| 1,895,744 | 1/1933 | Arnold | 150/34 |
| 1,976,698 | 10/1934 | Gihon | 190/51 X |
| 2,034,398 | 3/1936 | Kash | 150/34 |
| 2,463,993 | 3/1949 | Meyers | 190/52 X |

FOREIGN PATENTS OR APPLICATIONS

| | | | |
|---|---|---|---|
| 1,092,853 | 11/1954 | France | 190/42 |
| 202,126 | 6/1939 | Switzerland | 190/52 |

*Primary Examiner*—Donald F. Norton
*Attorney, Agent, or Firm*—William G. Rhines

[57] ABSTRACT

An attache case of the type used for carrying business papers and the like, adapted for carrying handled sporting equipment, such as a tennis racquet, in one embodiment includes an aperture in the upper end of one end panel of the case, and closure means therefor which may be moved to open the aperture to permit the handle of sporting equipment positioned within the case, to project therefrom.

10 Claims, 5 Drawing Figures

ATTACHE CASES

BACKGROUND OF THE INVENTION

Frequently, it is desired to carry one's sporting equipment while traveling for other purposes. Thus, for example, persons who are tennis players like to use their own racquets, even while they are on business trips. To have to carry the racquet separately is a great inconvenience, because of its awkward size and shape, particularly when other items of luggage are also being carried. On the other hand, it is impractical for such equipment to be carried inside one's luggage for several reasons. Frequently if the equipment is of the type which has a handle, such as a tennis racquet, it simply will not fit, being too long to be accommodated within some carrying cases. Furthermore, to so transport such equipment may be detrimental or harmful to the equipment itself. Thus, if one were to lay a tennis racquet flat in the bottom of a carrying case, not only might the strings and/or the frame be harmed by other objects which move about within the case as it is moved about, but simply the pressure on it of other contents of the case might be destructive or detrimental in effect. Additionally, it is desirable that the means used to carry such equipment also be presentable and useful for purposes other than transporting collateral equipment, such as tennis clothes, so that, for example, the business traveler might also use it to carry documents during the business phases of his trip. Previously, attempts have been made to provide case means for carrying handled sporting equipment. In this connection, reference is made to U.S. Pat. Nos. 1,976,698; 1,600,601; 3,399,750; and 3,368,655. Most such attempts have involved surface straps or other "hold-on" means for carrying the handled equipment on the outside of a bag which is suitable for transporting collateral sporting equipment, but is not particularly designed or suitable to carrying such things as business documents. The Gihon U.S. Pat. No. 1,976,698 proposed a handbag for carrying sporting equipment. including a tennis racquet, laid flat on the bottom with its handle projecting through a hole in the bottom of the end wall. However, such carrying means subjects the racquet to adverse and possibly damaging effects by virtue of the string portion being necessarily subjected to collision or pressure from the other contents of the bag. With such bags, because the aperture is positioned at the bottom of the end wall, such damage cannot be avoided since orienting the string portion perpendicular to the bottom is precluded, since this inevitably would cause the racquet handle projecting through the end wall to be oriented downward, making it impossible to set the bag down. Further, such a bag would be awkward at best because the racquet handle would, in effect, merely increase the size in the length dimension of the object being carried.

Accordingly, it is an object of this invention to provide a carrying means for handled sporting equipment.

Still another object is to provide such a means wherein the equipment being carried may be protected against adverse effects.

Another object of this invention is to provide such means which also is selectively adaptable to transport objects not associated with sporting activities.

Yet another object of the present invention is to provide a means for carrying handled sporting equipment with the handle of such equipment projecting from the carrying means in such a fashion as to minimize the awkwardness resulting therefrom.

Another object of this invention is to provide an attache case in which a tennis racquet may be carried, which may be converted to a normal attache case at will.

SUMMARY OF INVENTION

Desired objectives may be achieved through practice of the present invention which, in one embodiment, comprises an attache case adapted for transporting a tennis racquet, having an aperture in the upper end of one of its end panels which may be closed by an associated closure means so that the case may be used to transport business papers in the normal manner of an attache case, or may be opened to accomodate the handle of the tennis racquet positioned therein.

DESCRIPTION OF DRAWINGS

This invention may be understood from the description which follows and from the included drawings in which.

DESCRIPTION OF PREFERRED EMBODIMENTS

Figure 1:
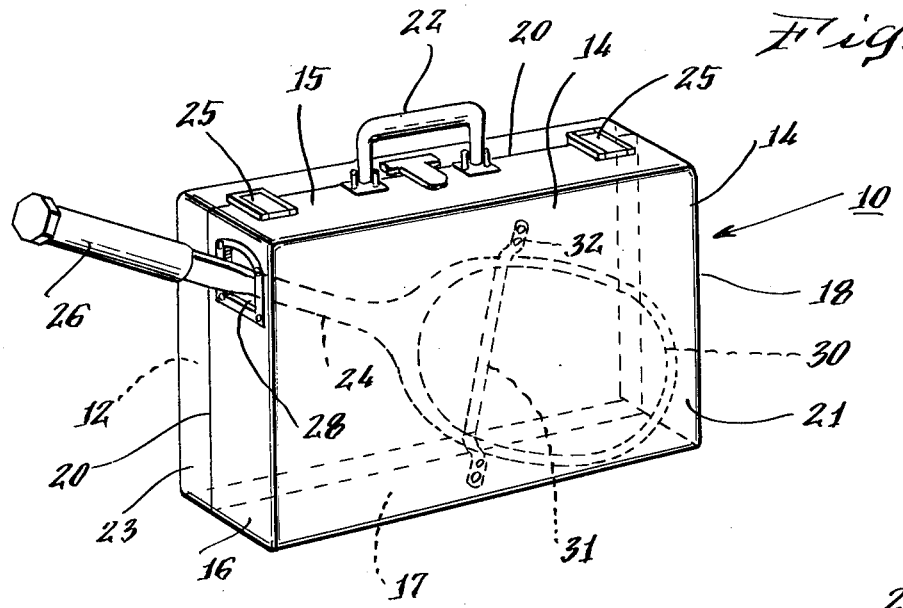
FIG. 1 illustrates one embodiment of the present invention.

Referring first to FIG. 1, there is depicted an attache case 10 which embodies the present invention. It may be made from leather, plastic, metal, or other suitable materials which are durable, attractive, abrasion resistant, and otherwise have desired properties for the use to which the case will be put. It includes rigid front and back panels 12, 14. It also includes rigid end panels 16, 18, a top panel 15, and a bottom panel 17; all of which comprise two parts which are separated along an opening line 20 to divide the case into a lid portion 21 and a main body portion 23 according to know per se design for attache cases. As is also known, a carrying handle 22, hasps 25, and hinges may also be provided.

As shown in FIG. 1, an end panel 16 is provided with an aperture 28 in its top region; i.e., at the end thereof nearest the top panel 14 which bears the handle 22. When the aperture 28 is open, the handle 26 of a tennis racquet 24 may be positioned therein when the racquet 24 is positioned within the case 10. It should be noted that with this invention, the racquet may be positioned on edge when the case is in the normal carrying position; i.e., with the plane of the strung portion substantially perpendicular to that of the bottom of the case. By this means, as contrasted with carrying means where the racquet is laid flat on the floor portion, adverse effects on the racquet may be avoided, since the racquet is thereby free from objects being piled upon it, and is less susceptible to collision by other objects within the case. It will also be apparent that because of the unique position of the aperture, the axis of the racquet being carried will be canted upward. This avoids the handle merely sticking straight out, as would be the case if the position of the aperture were such that the axis of the handle was parallel to the top, bottom, or end panels, thus making the case less awkward to handle when being carried with a racquet in it. It should also be noted that advantageously the racquet 24 may be held flat against the inside of the back panel 14 by means of a support strap 31 which may be removeably secured to the panel 14 by means of a snap 32 or other known per se device. When desired, the case 10 may be opened, the racquet removed, the aperture closed using means such as those hereinafter described, and the case used for such purposes as those for which an attache case might normally be utilized.

Figure 2:
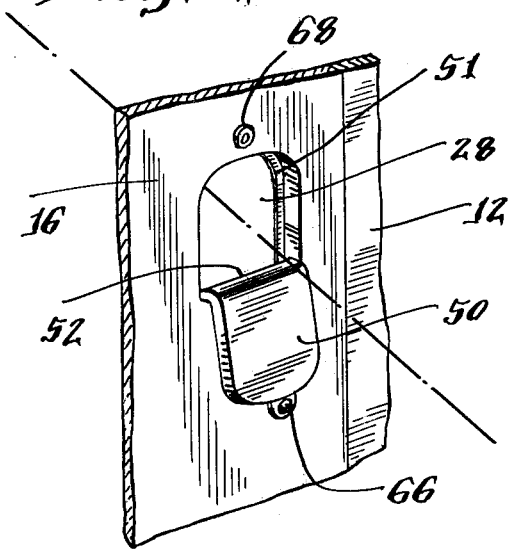
FIG. 2 illustrates an aperture closure means from the inside of an embodiment of this invention such as the one illustrated in FIG. 1.
Figure 3:
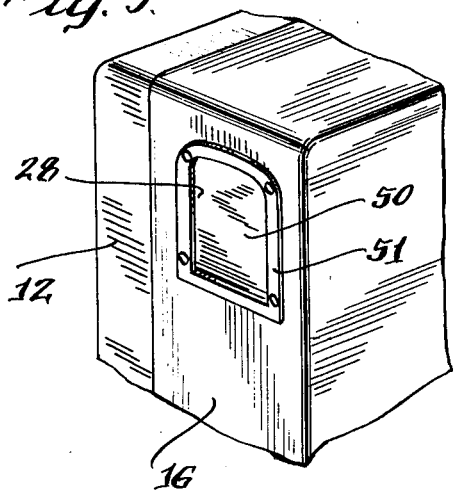
FIG. 3 illustrates the aperture closure shown in FIG. 2 from the outside of the case.

FIG. 2 illustrates means which might be utilized to effect closure of an aperture 28 in an end wall 16 of an embodiment of this invention such as that shown in FIG. 1. FIG. 2 is a view from the inside of the case and shows a flap 50 made from leather or other suitable material which may be hinged or otherwise pivoted about a bent portion of itself to effect desired opening or closure of the aperture. It will be apparent that leather or other fairly rigid yet supple material may be used advantageously because it can be bent back on itself, in effect forming its own hinge. When swung into the closed position, it may be prevented from merely passing through the aperture by a flange 51 made from brass or other metal or material which is sufficiently strong and preferably decorative. The aperture so closed is illustrated from the outside of the case in FIG. 3.

Figure 4:
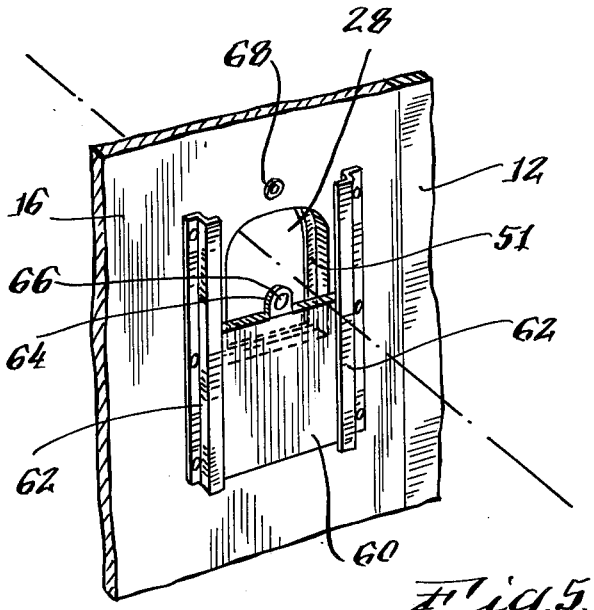
FIG. 4 illustrates an aperture closure means from the inside of an embodiment of this invention such as the one illustrated in FIG. 1.
Figure 5:
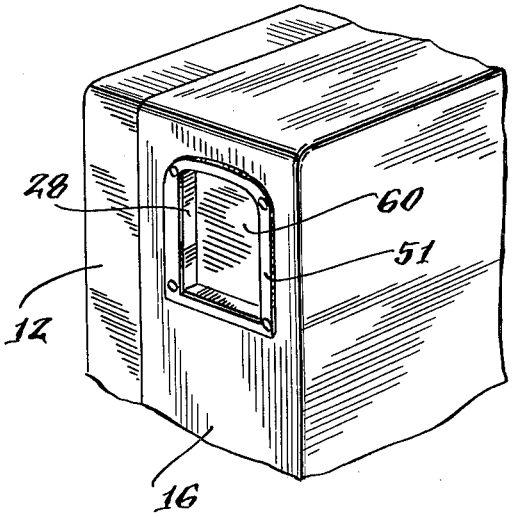
FIG. 5 illustrates the aperture closure shown in FIG. 4 from the outside of the case.

FIG. 4 illustrates another closure member from the inside of the case which may be utilized with embodiments of this invention. As shown, it comprises a flat gate 60 made from leather, plastic, or other suitable material, which is slideably affixed to the inside of the end panel 16 by means of tracks 62 made from brass or other suitable material. Advantageously, the flap 60 may include a snap-fastener 66 to engage with an associated snap-fastener member 68 affixed to the inside of the end panel 16, by means of which the slide flap 60 may be held in the position of closure of the aperture 28. FIG. 5 shows the aperture 28 in an end panel 16 from the outside of a case in such a closed position. Again, a flange 51, made from brass or other suitable material may be used, but it may not be necessary because, as will be apparent, the end wall 16 itself may perform the retaining function. However, even though such a flange may be unnecessary to perform this function, it may be desirable for aesthetic or other purposes, such as protecting the edges of the aperture 28 from abrasion.

It will be apparent from the foregoing that this invention may be practiced in a wide variety of alternative forms. Thus, cases other than leather-clad attache cases may be utilized. The aperture may be of a number of shapes and/or sizes, according to the size and shape of the handle to be accomodated. The aperture can be located anywhere in the top region of the end of the case; i.e., in that portion of the end which is in the general vicinity of the top part by which the case is suspended when being carried by its associated handle. Also, a variety of flaps may be used which are integral with the end panels; i.e., are affixed thereto in such a fashion that they will not inadvertently become disassociated therefrom but may be readily moved into and out of the position of closure of said aperture.

Accordingly, it is to be understood that the embodiments herein shown and discussed are by way of illustration but not of limitation, and that it is possible to produce a wide variety of embodiments without departing materially from the spirit or scope of this invention.

I claim:

1. An attache case having an aperture extending through and substantially totally surrounded by an uninterrupted portion of the top region of one of its end panels, and means inside said case which is integral with said end panel and is moveable into and out of a position of closure of said aperture.

2. The case described in claim 1 wherein said means is a flap which is moveably affixed at one of its ends to said end panel about which end it is pivotally moveable into and out of said position of closure.

3. The case described in claim 1 wherein said means is a flat gate which is slideably affixed to the inside of said panel by retaining means, and is slideably moveable into and out of said position of closure.

4. The case described in claim 1 including means for removeably securing handled sporting apparatus within said case with the handle thereof projecting outward from said case through said aperture.

5. The case described in claim 2 including means for removeably securing handled sporting apparatus within said case with the handle thereof projecting outward from said case through said aperture.

6. The case described in claim 3 including means for removeably securing handled sporting apparatus within said case with the handle thereof projecting outward from said case through said aperture.

7. An attache case adapted for transporting sporting equipment which is greater in length than any dimension of said case comprising an aperture through and substantially totally surrounded by an uninterrupted portion of the top region of an end panel of said case adjacent to the juncture of one side of said end panel and one among the front and back panels of said case, means for removeably securing such equipment to the inside of said one among said front and back panels and moveable closure means integral with said end panel for selectively effecting closure of said aperture.

8. The case described in claim 7 wherein said closure means is a flap affixed at one of its ends to said end panel.

9. The case described in claim 8 including flange means extending into said aperture at the outside of said end panel.

10. The case described in claim 7 wherein said closure means is a flat gate slideably affixed to the inside of said end panel by means of vertically oriented lateral support rails.

* * * * *